US007635322B2

(12) United States Patent
Parrilla

(10) Patent No.: US 7,635,322 B2
(45) Date of Patent: Dec. 22, 2009

(54) SQUAT RACK

(76) Inventor: Marco Parrilla, 1941 E. 34th St., Lorain, OH (US) 44055

( * ) Notice: Subject to any disclaimer, the term of this patent is extended or adjusted under 35 U.S.C. 154(b) by 0 days.

(21) Appl. No.: 11/946,596

(22) Filed: Nov. 28, 2007

(65) Prior Publication Data

US 2009/0137368 A1 May 28, 2009

Related U.S. Application Data

(60) Provisional application No. 60/990,507, filed on Nov. 27, 2007.

(51) Int. Cl.
*A63B 21/078* (2006.01)
*A63B 21/06* (2006.01)

(52) U.S. Cl. ..... 482/104; 482/94

(58) Field of Classification Search ..... 482/93, 482/98, 104, 106, 94, 101; 52/36; 211/85.7, 211/191, 204, 103, 187, 190, 206, 207; 248/161, 248/125.1, 407, 411; 405/288–290
See application file for complete search history.

(56) References Cited

U.S. PATENT DOCUMENTS 4,286,782 A * 9/1981 Fuhrhop ..... 482/99
4,306,715 A 12/1981 Sutherland
4,711,449 A * 12/1987 Ochab ..... 482/104
4,776,587 A 10/1988 Carlson et al.
4,795,149 A * 1/1989 Pearson ..... 482/98
4,898,381 A * 2/1990 Gordon ..... 482/103
5,306,220 A * 4/1994 Kearney ..... 482/94
5,346,448 A * 9/1994 Sollo ..... 482/104
5,411,458 A 5/1995 Giust
5,468,203 A * 11/1995 Okonkwo ..... 482/104
5,582,564 A * 12/1996 Nichols et al. ..... 482/97
5,669,859 A * 9/1997 Liggett et al. ..... 482/94
6,149,556 A * 11/2000 Jordan ..... 482/104
6,685,601 B1 * 2/2004 Knapp ..... 482/104
7,025,712 B2 * 4/2006 Parrilla ..... 482/104
7,338,416 B2 * 3/2008 Smith ..... 482/104
7,374,516 B2 * 5/2008 Lundquist ..... 482/104
7,484,461 B2 2/2009 Britcher

* cited by examiner

*Primary Examiner*—Loan H Thanh
*Assistant Examiner*—Allana Lewin
(74) *Attorney, Agent, or Firm*—Sand & Sebolt

(57) ABSTRACT

An exercise device for supporting a barbell and weights thereon. The exercise device includes a pair of support members that are independently selectively engageable on a support beam. Each support member includes an elongated post with a first end positioned adjacent a floor surface and a second end having an adjustable clamp assembly for engaging the support beam. The clamp assembly suspends the post from the beam and is selectively engaged between a first clamping position and a second movable position. Each support post further includes an adjustable bar support assembly for retaining the barbell thereon. A leveling assembly may be provided on the first end of the post to orient the post at right angles to the floor and beam. The exercise device may further include a safety catch assembly mounted on each of the support members and one or more optional weight support assemblies for storing weights thereon.

24 Claims, 10 Drawing Sheets

SQUAT RACK

CROSS-REFERENCE TO RELATED APPLICATIONS

This application is a U.S. standard utility application claiming priority from U.S. Provisional Application Ser. No. 60/990,507, filed Nov. 27, 2007, the entire disclosure of which is incorporated herein by reference.

BACKGROUND OF THE INVENTION

1. Technical Field

This invention generally relates to exercise devices for performing squat type exercises with barbells. More particularly, the invention relates to a barbell support which extends adjacent the user's shoulders for supporting the barbell. Specifically, the invention relates to an adjustable suspended squat rack for supporting barbells thereon.

2. Background Information

The general field of this invention and some of the devices used to perform squatting exercises were discussed in U.S. Pat. No. 7,025,712, issued to the instant inventor on Apr. 11, 2006. In this patent, it was disclosed that squatting exercises are performed by athletes to build up and strengthen their leg muscles. Squats are typically performed by supporting free weights in the form of a barbell and disk weights, the barbell being disposed across the lifter's shoulders and gradually descending from a standing position to a squatting position. During squats the back of the lifter does not remain straight as the lifter descends, but rather the angle of the back off of vertical increases as the lifter descends.

Various types of exercise equipment have been devised to facilitate squatting exercises, the most common being a basic upright frame having a ground contacting base with a pair of upright members spaced a distance apart to support opposite end portions of the barbell on U-shaped barbell cradles at respective upper free ends thereof. The lifter places the barbell on the cradles and adds the desired disk weights to each end of the barbell. The weights are secured to the barbell against respective radial flanges using a pair of collars. The cradles and supported barbell with weights are disposed at a height which is approximately shoulder level for the average lifter. Some such exercise equipment have multiples pairs of cradles disposed at various heights or telescoping upright members permit adjustment to fit the particular shoulder height of various lifters.

Another problem encountered with such exercise equipment is that it is not easily portable. While this might not be a problem for health clubs and other gyms which use such equipment, it is typically undesirable for home gyms. While interest in exercise has expanded over the years, many members of the public have found that belonging to a health club is too expensive and time consuming due to commute times. This has increased the demand for smaller, less expensive apparatus that may be placed in the home. However, use of exercise equipment in the home poses a serious space problem for many potential owners of home gyms. Because such equipment must be quite sturdy and durable to support heavy weights and high forces required by lifters, such exercise equipment is usually very heavy and must be fixed to the floor. Hence, present exercise equipment is not very maneuverable and is, therefore, not well suited for residential or non-institutional use.

An example of such exercise equipment particularly designed for squatting exercises is the barbell storage and exercise rack disclosed in U.S. Pat. No. 4,306,715, issued to Sutherland on Dec. 22, 1981. This exercise rack includes a pair of cradles in which the barbells are laterally received and supported in a stored position. The cradles are adjustable in height to permit the lifter to remove and replace the barbells from a comfortable standing position. The exercise rack further includes a pair of safety side rails which are spaced apart a distance sufficient to permit the user to stand between the rails to perform squatting and other weight lifting exercises. The side rails are also adjustable in height so as to be disposed slightly below the lower position assumed by the barbells during the squats to prevent the barbells from inadvertently falling on the lifter if the weight slips or becomes too heavy to lift as exercise is conducted. The exercise rack takes up significant floor space, is likely relatively expensive to buy, and is not that easily portable.

Another example of exercise equipment suitable for squatting exercises is disclosed in U.S. Pat. No. 5,411,458 issued to Giust on May 2, 1995. This equipment comprises an angled track squat exercise apparatus. The exercise apparatus includes a horizontally disposed base frame which supports at opposite ends a vertically disposed foot plate frame and a weight rack frame carrying a plurality of weights. A track frame is supported on the base frame between the foot plate frame and the weight rack frame. The track frame includes a horizontal section and a section which is downwardly inclined from the horizontal section. A carriage is supported on the track frame which is firstly displaced upwardly along the inclined section, then horizontally along the horizontal section by the legs and feet of the lifter pushing against the foot plate frame. The selected one of the weights is lifted in the weight rack as the carriage is displaced by the lifter. The exercise apparatus again takes up significant floor space, is likely relative expensive to buy and is not that easily portable.

The aforementioned patent No. 7,025,712 to the instant inventor addressed a solution to the problems in this field of home gym equipment. The patent disclosed a squat rack for use in the home and which is designed to be mountable to an overhead support beam that extends between opposed walls. The squat rack is designed for use in a room, such as in a basement, where an I-beam extends between the opposed walls. Specifically, this device was designed to be suspended from the I-beam and includes a pair of barbell support frames. Each support frame includes a frame mount and a cradle that is adapted to retain one of the end portions of the lifting bar. The cradle of each support frame is generally J-shaped and includes an upper end portion, a lower hook and a central portion disposed therebetween. The J-shaped member is adjustably connected to a generally vertically-disposed surface of the frame mount. This surface includes a plurality of vertical positions thereon to facilitate use of the squat rack by persons of differing heights. The squat rack further included a pair of mounting assemblies, each of which comprises a clamp that is adapted to attached to a horizontally disposed flange which forms part of the overhead support beam. The clamps vertically secure the frame mount to one of the support frame and support beam such that the cradle is disposed in parallel relation below the beam to support the barbells at generally shoulder height of the person who will perform the squat-type exercise.

While this device works very well, it is essentially designed to be more or less permanently installed on the I-beam. The barbell and weights are supported a distance downwardly from the I-beam and above the floor by the cradles. The actual height is dictated by the position to which the J-hooks are adjusted. As such, the barbell and weights may become a hazard to persons moving through the room where this device is mounted, with that room typically being a basement area. If it is desired to store the device or to move it for some reason, the mounting flanges have to be disengaged from the I-beam and the device has to be reinstalled at the new location. All of this is time consuming and counterproductive in that the need for this breaking down and reinstalling of the equipment might cause the user to change their mind and avoid use of the equipment.

There is therefore a need in the art for a device that is suspendable from an I-beam but is easily and quickly moved from one end of the I-beam to the other while not compromising on safety of the device.

SUMMARY OF THE INVENTION

The device of the present invention is a squat rack for installation in a home for use in adjustably supporting a barbell and weights thereon. The exercise device includes a pair of support members that are independently selectively engageable on a support beam. Each support member includes an elongated post with a first end positioned adjacent a floor surface and a second end having an adjustable clamp assembly for engaging the support beam. The clamp assembly suspends the post from the beam and is selectively engaged between a first clamping position and a second movable position. Each support post further includes an adjustable bar support assembly for retaining the barbell thereon. A leveling assembly may be provided on the first end of the post to orient the post at right angles to the floor and beam. The exercise device may further include a safety catch assembly mounted on each of the support members and one or more optional weight support assemblies for storing weights thereon.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
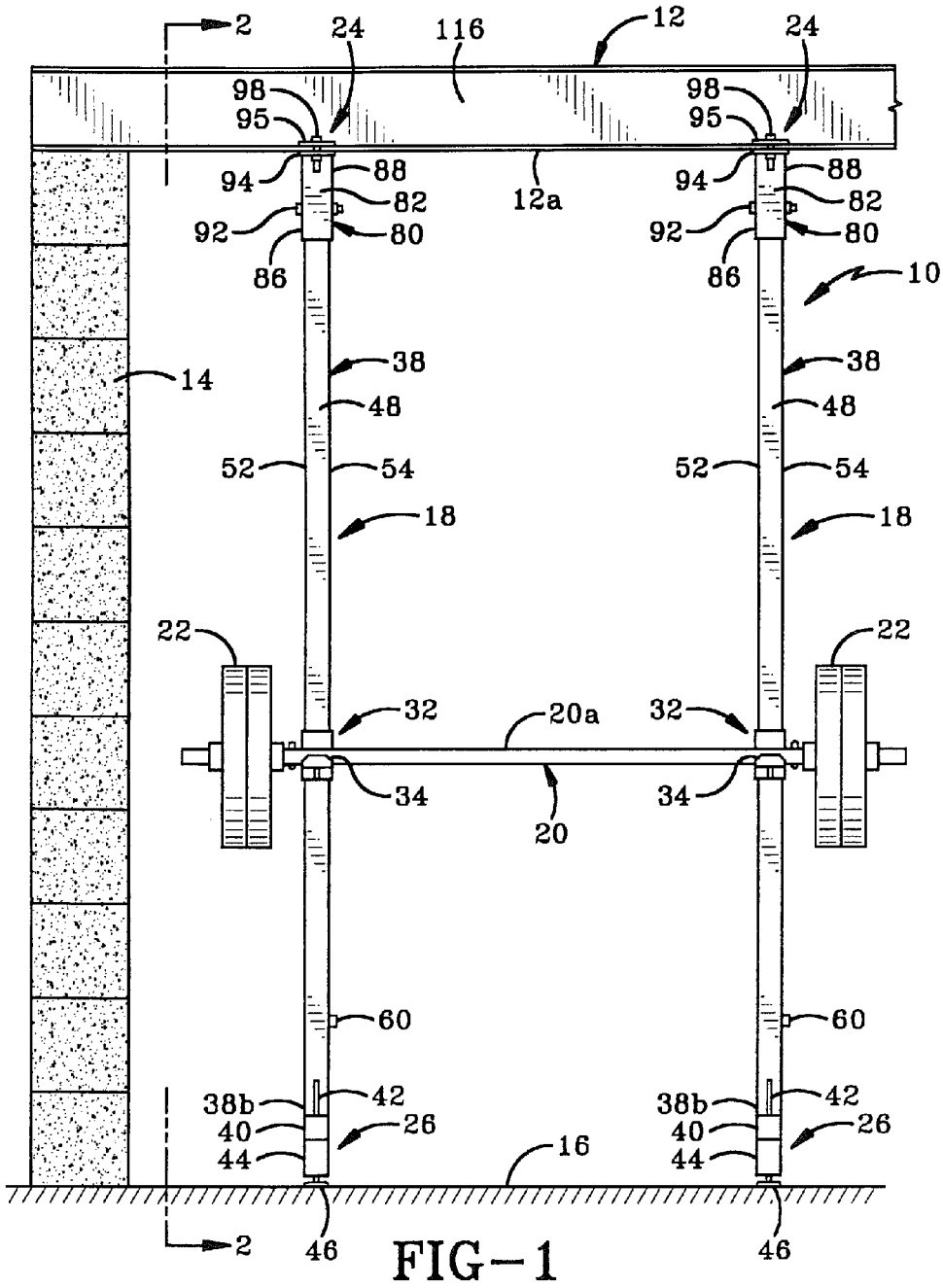
FIG. 1 is a front elevational view of a squat rack in accordance with the present invention.

Referring to FIGS. 1-11, there is shown a squat rack in accordance with the present invention and generally indicated at 10. Squat rack 10 is of a type designed for use in a home gym and is specifically designed for set-up in a region of a home such as a basement. More specifically, rack 10 is designed to engage an I-beam 12 that extends between an opposed pair of walls 14. Beam 12 is spaced a distance from the floor 16 and proximate the ceiling (not shown) of the room.

Rack 10 comprises a pair of substantially identical support members 18 that are each individually engageable with beam 12 and extend between beam 12 and floor 16. Support members 18 are laterally positionable a distance apart from each other so that they are suitably spaced to support a barbell 20 between them. The barbell 20 includes a bar 20 with a plurality of removable weights 22 thereon.

In accordance with a specific feature of the present invention, support members 18 include a clamp assembly 24 that engages beam 12 and one or more leveling assemblies that engage floor 16. Clamp assembly 24 includes a clamping mechanism and a moving mechanism as will be hereinafter described. Clamp assembly 24 is selectively engageable in a first clamping position that fixedly secures clamp assembly 24 in a specific location along beam 12, and a second movable position that allows the user to adjust the position of support member 24 on beam 12. When clamp assembly 24 is in first position the clamping mechanism is engaged and the moving mechanism is disengaged. When clamp assembly 24 is in the second position, the clamping mechanism is disengaged and the moving mechanism is engaged. When clamp assembly 24 is in the second position, the leveling assembly 26 may need to be retracted partially so that it does not drag along the floor as support member 18 is moved therealong. Each support member 18 also includes a bar support assembly 32 that permits the user to adjust the position of the J-shaped hooks 34 thereon so that barbell 20 will be at the correct height for the person to exercise safely.

As mentioned previously, the two support members 18 are substantially identical and therefore this description applies equally to each support member. Support member 18 comprises a support post 38 that is of a sufficient length to extend from proximate beam 12 to a spaced distance from floor 16. It has been found that a suitable length for post 38, as measured between upper end 38*a* (FIG. 6) and lower end 38*b* (FIG. 1), is between eighty-five to ninety-five inches. Post 38 further includes a front wall 48, a rear wall 50 and side walls 52, 54. Preferably, post 38 is substantially square in cross-sectional shape. A plurality of aligned pairs of holes 56 are defined in side walls 52, 54 and are spaced at intervals between upper and lower ends 38*a*, 38*b*. Preferably, holes 56 are vertically spaced about three inches apart from each other. The lowermost pair of aligned holes 56*a* (FIG. 2) preferably is spaced a distance of about fifteen to twenty inches off the floor 16 when support member 18 is fully installed on beam 12. One or more stops 60 may be provided on any one of the walls of post 38 to provide a lowermost level beyond which bar holder assembly 34 cannot be moved.

Figure 2:
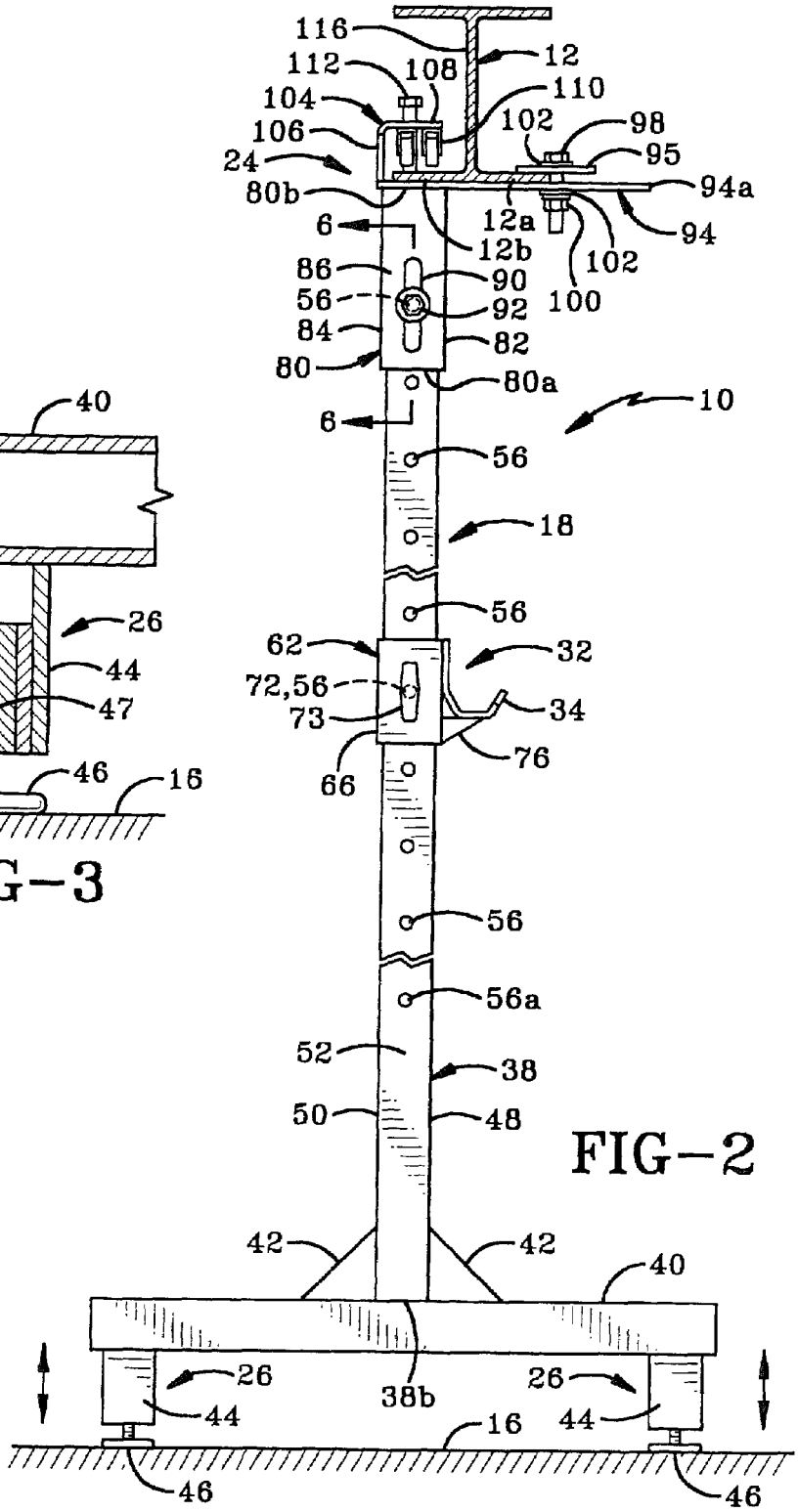
FIG. 2 is a side elevational view of the squat rack of FIG. 1.

It will be understood that while post 38 has been illustrated and described as a substantially hollow tube, it may be a substantially flat piece of metal or may be a substantially solid body. Post 38 is provided to aid in distributing the load applied to the squat rack 10 by a barbell 20 and weights 22 downwardly into floor 16 and upwardly into beam 12. Consequently, no matter whether post 38 is a hollow tube, a solid tube or a flat piece of metal, post 38 must be manufactured to be sufficiently strong and sturdy enough to safely carry the load of the barbell 20 and weights 22 thereon. In order to aid in distributing the load, lower end 38*b* of post 38 is welded to a crossbar 40. Post 38 therefore has a generally upside-down "T" in shape when viewed from the side (FIG. 2). Support brackets 42 are welded between post 38 and crossbar 40 to strengthen support member 18.

Figure 3:
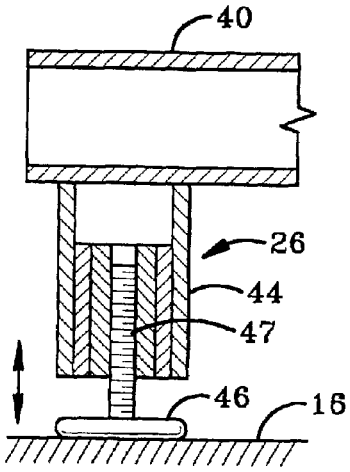
FIG. 3 is a cross-sectional side view of the leveling assembly at the floor-engaging end of the squat rack.

Referring to FIGS. 2-3 and in accordance with a specific feature of the present invention, a pair of leveling assemblies 26 extend downwardly from crossbar 40 to engage the floor 16. Leveling assemblies 26 are spaced a distance apart from each other on crossbar 40. Each leveling assembly 26 includes a leveling tube 44 that is sized to threadably engage a rotatable foot 46 therein. Foot 46 may be rotated in a first direction so that the shaft 47 thereof moves further inwardly into tube 44, thereby reducing the distance between crossbar 40 and foot 46. Foot 46 may be rotated in a second direction so that the shaft 47 thereof moves further outwardly from tube 44, thereby increasing the distance between crossbar 40 and foot 46. The outermost surface of foot 46 may be knurled to aid in rotating the same by simply applying finger pressure thereto. Each leveling assembly 26 is independently adjustable to adjust the horizontal orientation of crossbar 40. Additionally, the distance between the leveling tubes 44 is between 15 and 30 inches to provide a greater area over which the load from barbell 20 and weights 22 may be spread. It will be understood, however, that the distance between tubes 44 may be of any suitable spacing to take the load of any size barbell 20. For example, a squat rack manufactured from tubing that is approximate 2 inches in width can take a load of up to 1,700 lbs. The size of the components of squat rack 10 and the materials used to manufacture the same are a matter of design choice.

Figure 4:
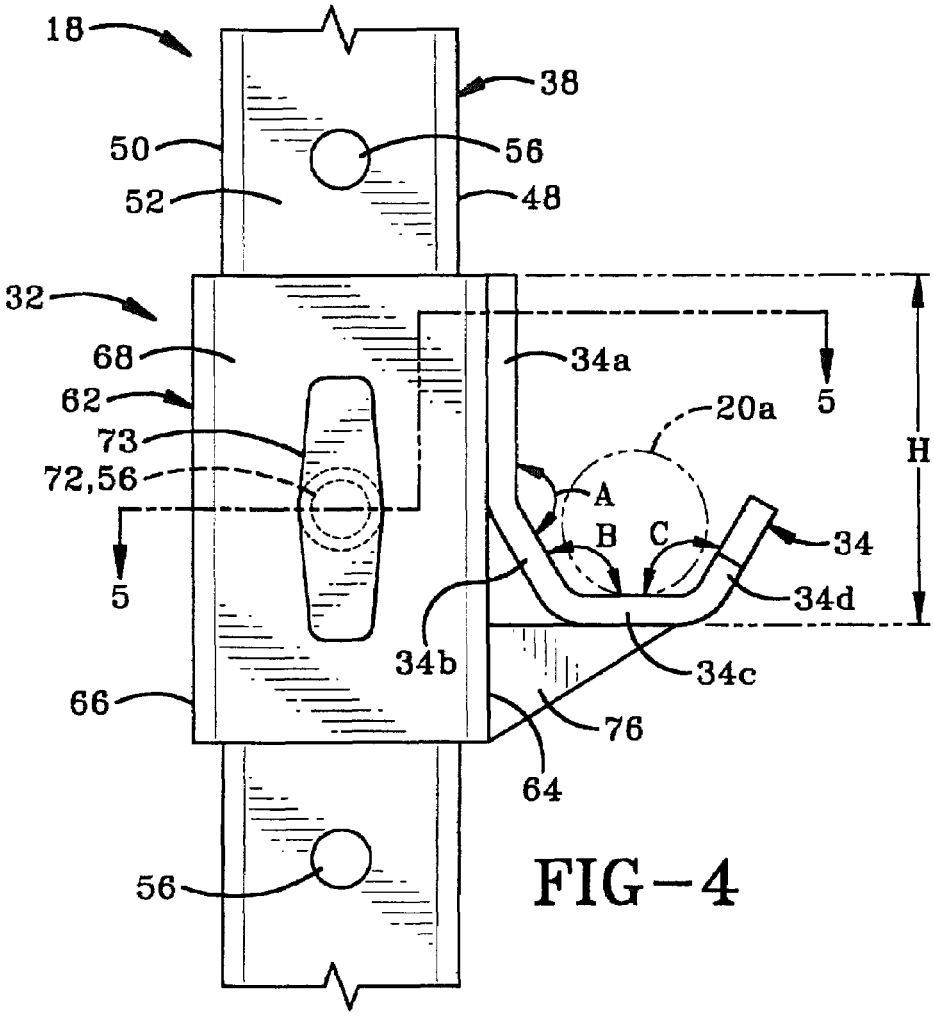
FIG. 4 is an enlarged side view of the bar support assembly.
Figure 5:
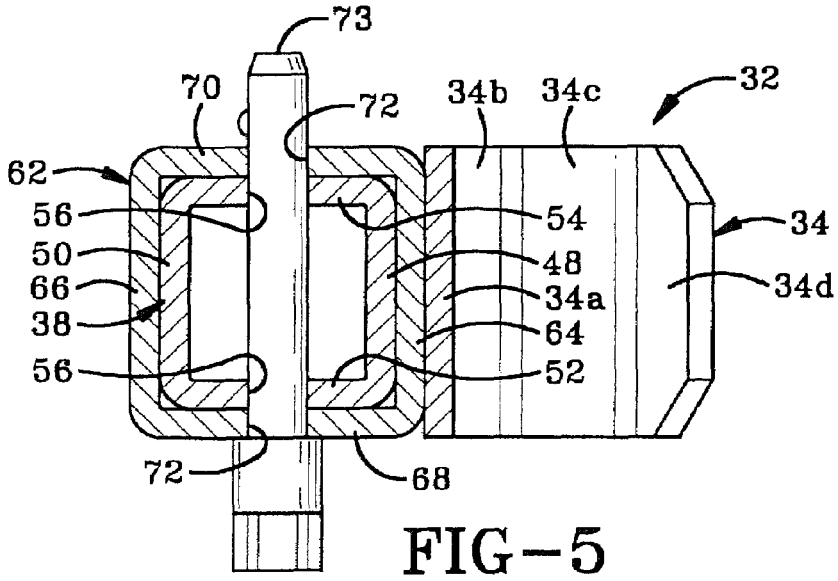
FIG. 5 is a cross-sectional top view of the bar support assembly taken through line 5-5 of FIG. 4.
Figure 6:
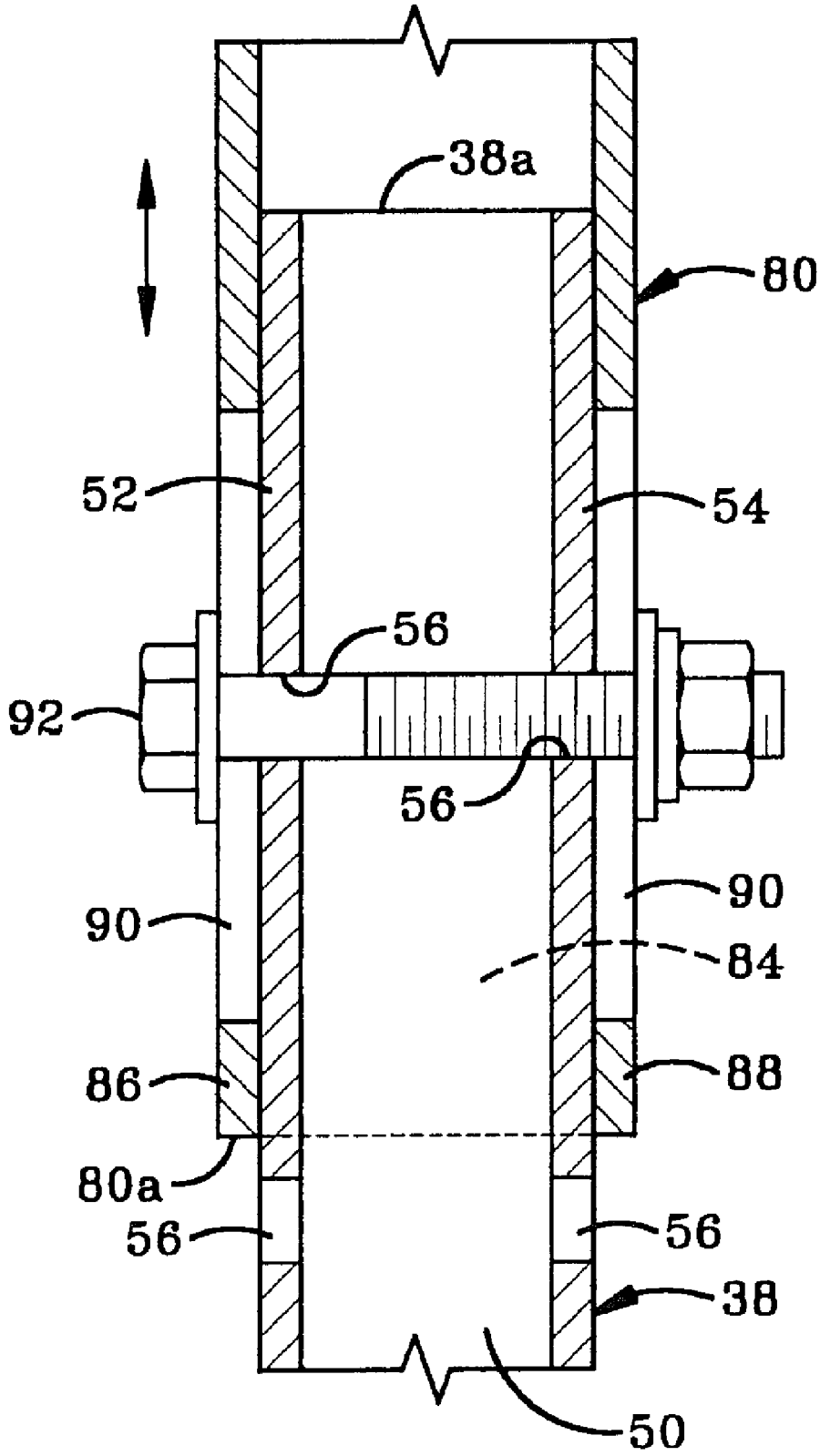
FIG. 6 is a cross-sectional front view of the guide sleeve taken through line 6-6 of FIG. 2.
Figure 7:
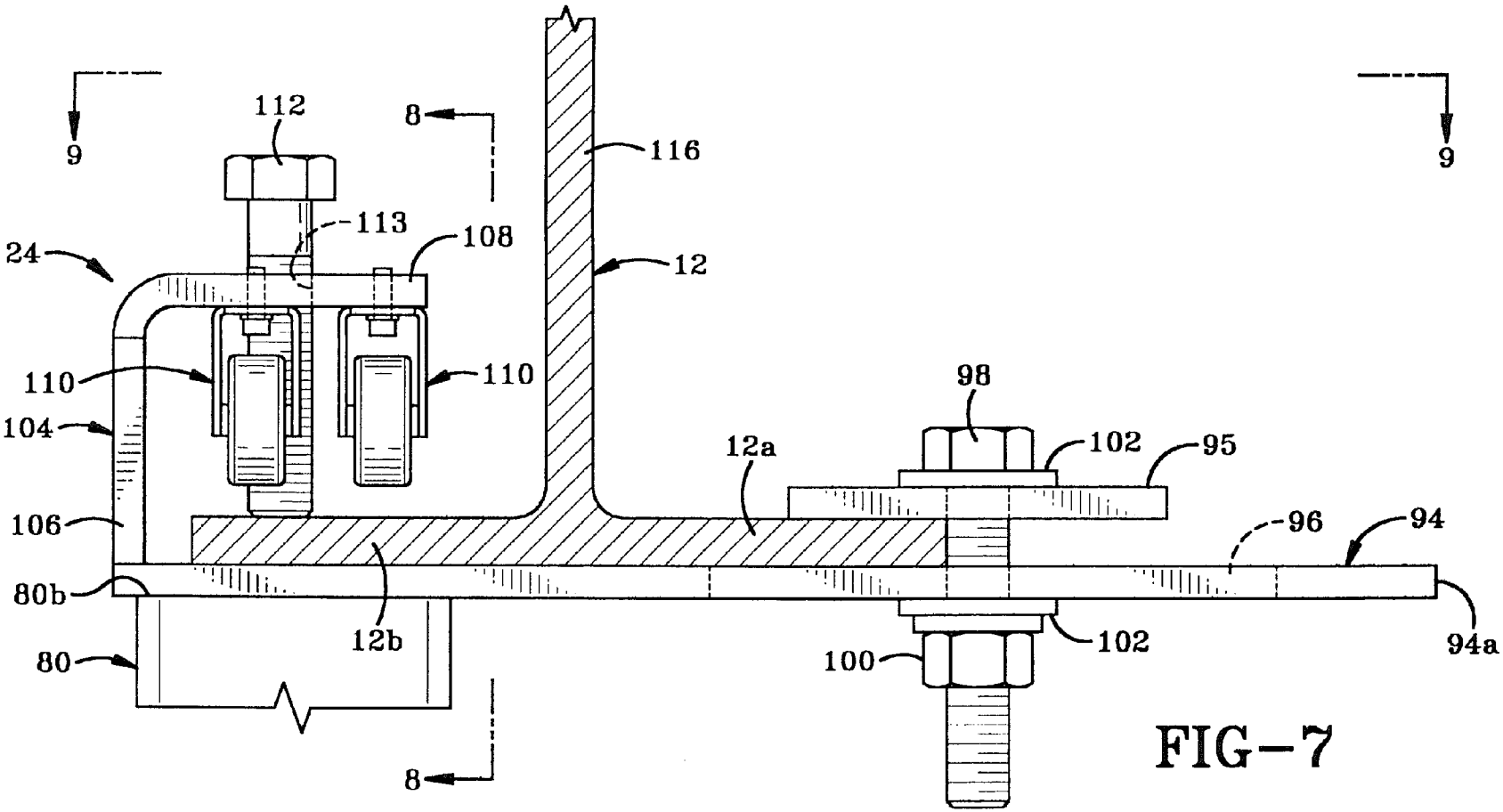
FIG. 7 is a cross sectional side view of a portion of the clamp assembly at the beam-engaging end of the squat rack.
Figure 8:
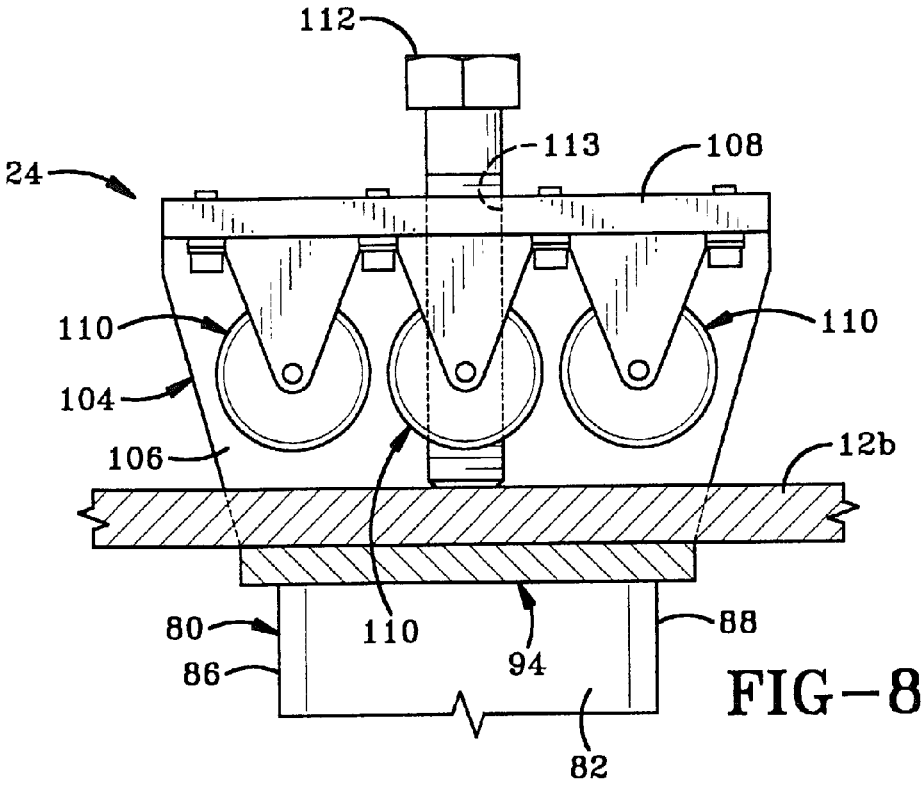
FIG. 8 is a front view of the clamp plate assembly taken through line 8-8 of FIG. 7 and showing the clamp plate clampingly engaging the I-beam.
Figure 10:
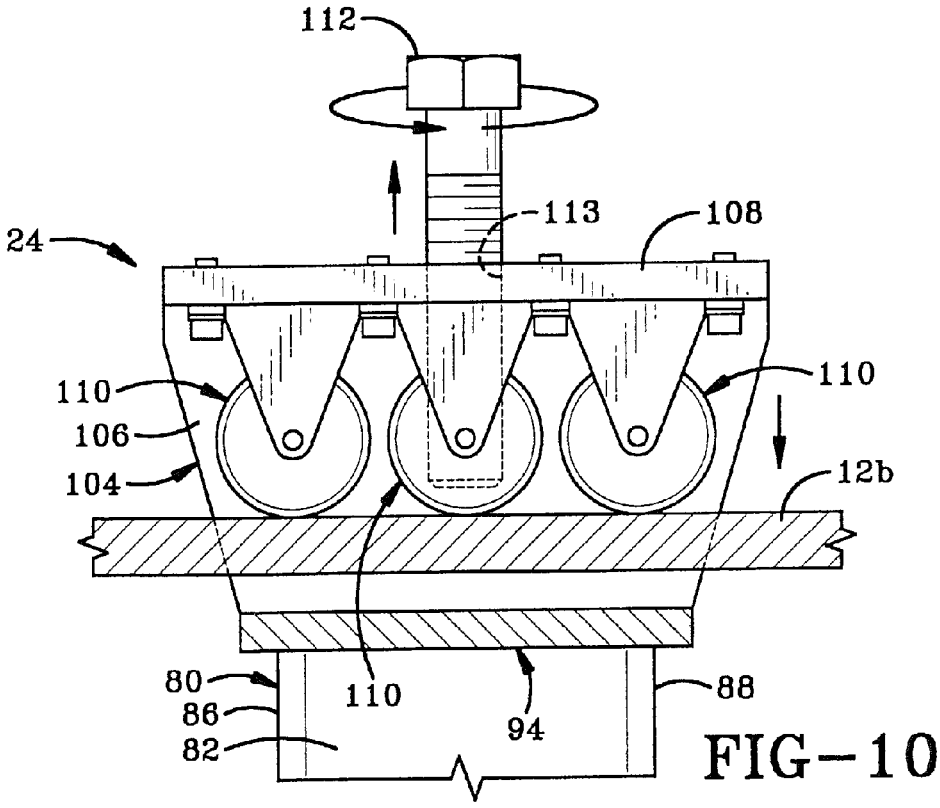
FIG. 10 is a front view of the clamp plate assembly taken through line 8-8 of FIG. 7 but showing the clamp plate slidingly engaged with the I-beam.
Figure 9:
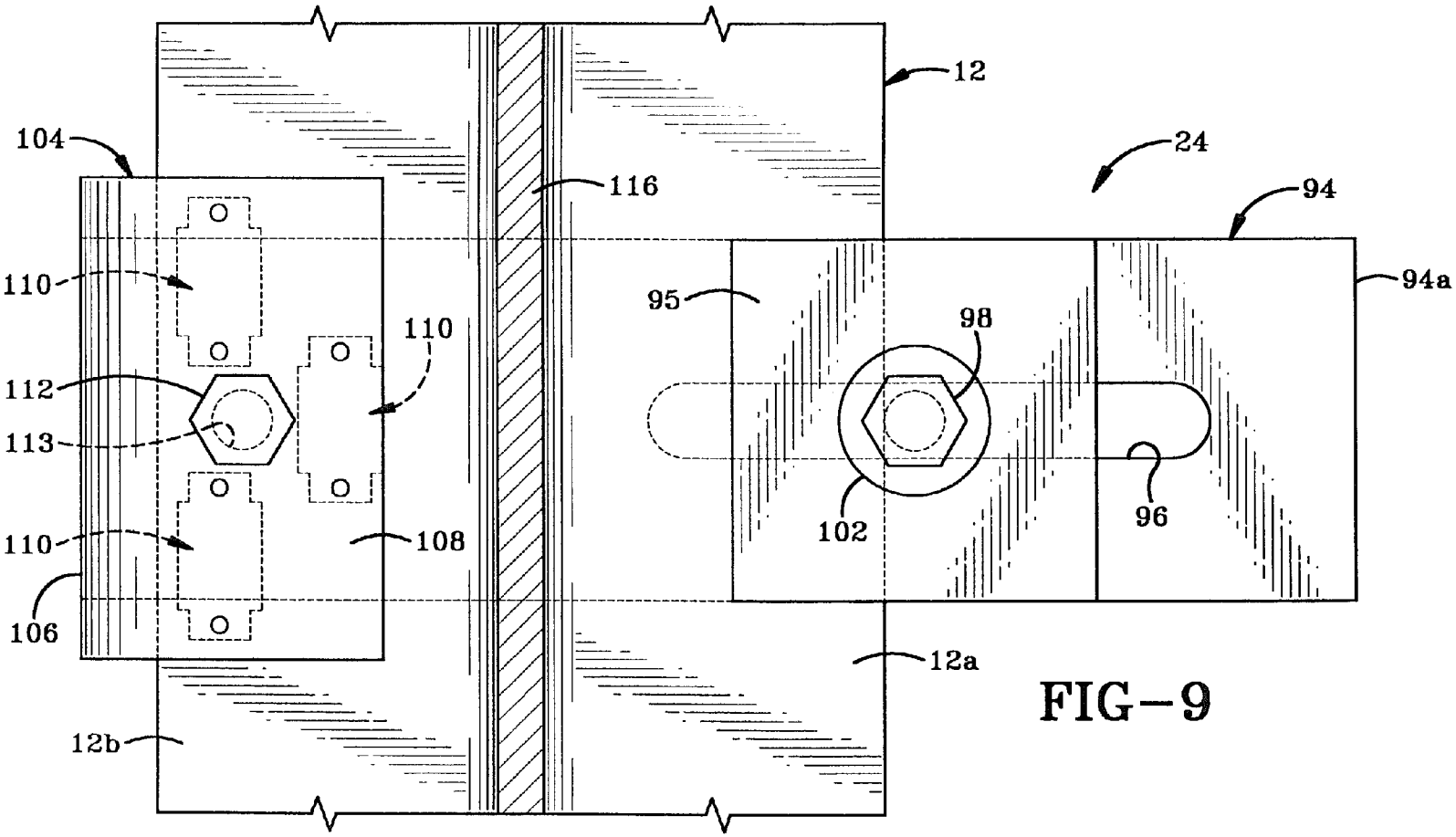
FIG. 9 is a top view of the clamp plate assembly taken through line 9-9 of FIG. 7.

FIGS. 4 & 5 show the bar support assembly 32 in greater detail. Bar support assembly 32 comprises a sleeve 62 that includes the J-shaped hook 34 thereon. Sleeve 62 preferably is complementary in size and cross-sectional shape to post 38 and includes a front wall 64, a rear wall 66, and side walls 68, 70. Walls 64-70 of sleeve 62 closely abut front, rear and side walls 48-54 of post 38, but with sufficient clearance to permit sleeve 62 to slide along post 38. Although not shown in the attached figures, sleeve 62 may also include a mechanism, such as small ratchet rollers, to enable sleeve 62 to slide more easily along post 38. If a mechanism such as ratchet rollers is provided, the rollers preferably will slide easily in a direction toward upper end 38*a* of post 38 and will ratchet when sleeve 62 is moved in a direction downwardly toward lower end 38*b* of post 38. The downward movement of sleeve 62 will therefore be more difficult than the upward movement thereof.

Side walls 68, 70 of sleeve 62 define a pair of spaced apart apertures 72 that are selectively alignable with holes 56 in side walls 52, 54 of post 38 as sleeve 62 is moved upwardly or downwardly along post 38. When apertures 72 are aligned with a pair of holes 56 (FIG. 5), then a quick release pin 73 is inserted therethrough to lock sleeve 62 in position on post 38. It will be understood that while the holes 56 and apertures 72 are disclosed as formed on the side walls of the post and sleeve respectively, the holes 56 and apertures 72 may be provided on any of the walls of post and sleeve, provided they are alignable with each other to receive pin 73 therethrough. It will further be understood that sleeve 62 may alternatively be replaced with a plate having an aperture defined therein and includes catches that pass around the rear wall 50 of post 38.

In accordance with yet another feature of the present invention, the J-shaped hook 34 is welded or otherwise fixedly secured to front wall 64 of sleeve 62. Hook 34 is provided to receive and retain the bar 20*a* of barbell 20 therein. Hook 34 preferably includes a rear section 34*a*, a first angled section 34*b*, a bottom section 34*c* and a second angled section 34*d*. The angle "A" between rear and first sections 34*a*, 34*b* preferably is about 150°. The angle "B" between first and bottom sections 34*b*, 34*c* preferably is about 120°. The angle "C" between bottom and second sections 34*c*, 34*d* preferably is about 120°. It should be noted that second section 34*d* extends upwardly for a distance that is around one third of the total height "H" of rear section 34*a*. This not only ensures that bar 20*a* will not accidentally roll off hook 34, but also ensures that the person lifting the barbell 20 does not need to struggle to get the bar 20*a* over second section 34*d* to place it back in the cradle formed by hook 34. A support bracket 76 extends outwardly from front wall 64 of sleeve 62 for substantially the entire length of bottom section 34*c* of hook 34. Bracket 76 preferably is welded to both front wall 64 and bottom section 34*c* and is provided to strengthen hook 34 and prevent the same from being deformed by the weight of barbell 20 and weights 22.

In accordance with another specific feature of the present invention, FIGS. 1, 2 and 6-10 show the clamp assembly 24 that is provided to engage beam 12. Clamp assembly 24 comprises a guide sleeve 80 that is substantially complementary in cross-sectional shape and size to slide on post 34. Guide sleeve 80 includes a front wall 82, a rear wall 84 and side walls 86, 88. An elongated slot 90 is defined in each of side walls 86, 88 and these slots 90 are aligned with each other. The bottom end 80*a* of guide sleeve 80 is open so that upper end 38*a* of post 38 can be received therethrough. A locking pin 92, with an associated nut and washers, is used to secure guide sleeve 80 in place on post 38. Locking pin 92 is inserted through slots 90 and an aligned pair of holes 56 in post 38. The elongated slot 90 ensures that any one of several pairs of aligned holes 56 in upper end 38*a* of post 38 can be selected for the insertion of locking pin 92.

Clamp assembly 24 further includes a horizontal plate 94 that extends across the upper end 80*b* (FIG. 7) of guide sleeve 80 and rearwardly away from the rear wall 50 of post 38. Plate 94 defines a longitudinal slot 96 that extends from about half way along the length of plate toward the outer edge 94*a* thereof. Slot 96 terminates a distance inwardly from outer edge 94*a*. Horizontal plate 94 is clamped to a flange 12*a* of beam 12 by way of a clamp plate 95, bolt 98 and a nut 100 that cooperate with washers 102.

In accordance with yet another feature of the present invention, clamp assembly 24 is also provided with a clamp plate 104 provided with both a clamping mechanism and moving mechanism that are selectively engageable with flange 12*b* of beam 12. Clamp plate 104 is generally L-shaped having a first leg 106 that extends upwardly from horizontal plate 94. First leg 106 is disposed substantially at right angles to plate 94. A second leg 108 of clamp plate 104 extends rearwardly from first leg 106 and is oriented substantially parallel to plate 94. Second leg 108 only extends rearwardly from first leg 106 for a distance that is generally equal to the width of post 38. The moving mechanism that is provided on clamp plate 104 comprises a plurality of casters 110 that are secured to second leg 108 and extend downwardly into the gap between second leg 108 and plate 94. Preferably, two rows of mini-casters 110 are secured in a suitable manner to second leg 108 provided. Clamping mechanism comprises a clamping bolt 112 that extends through a threaded aperture 113 in second leg 108. Bolt 112 is provided to selectively clampingly engage flange 12*b* of beam 12.

Referring to FIGS. 1-11, the squat rack 10 of the present invention is used in the following manner. During the initial set-up of the exercise device a first one of the support members 18, is connected to beam 12. Initially, clamping bolts 112 and 98 must be sufficiently unscrewed to permit horizontal plate 94 to slide under the lower surface of flange 12*b*/12*a* on I-beam 12 and allow clamp plates 104, 95 to slide over upper surfaces of flange 12*b*/12*a* respectively. Support member 18 is pushed inwardly toward the web 116 of the I-beam 12 until the lowermost surface of bolt 112 can engage flange 12*b* and side of bolt 95 can engage the outermost edge of flange 12*a*. Because clamping bolt 112 is in a non-clamping position at this stage, casters 110 may be used to slide support member 18 horizontally along flange 12*a* until support member 18 is in an appropriate location along the length of beam 12. At this point, the user loosely engages clamping bolt 112 by rotating the same into a loosely clamping position with an upper surface of flange 12*b*. Similarly, clamping bolt 98 is pushed inwardly 96 until it engages the edge of flange 12*a*. Bolt 98 is rotated until clamp plate 95 is loosely clamped against the upper surface of flange 12*a*.

The user will then check to see if post 38 is extending downwardly to a degree sufficient to allow leveling assemblies 26 to engage the floor 16. If post 38 is too short, it may be effectively lengthened by adjusting the relative position of guide sleeve 80 and post 38. This is accomplished by removing locking pin 92, sliding post 38 outwardly and downwardly from guide sleeve 80 until leveling assemblies 26 are in a suitable position relative to floor 16. Similarly, if post 38 is found to be too long, post 38 may be slid inwardly into guide sleeve 80. The guide sleeve 80 and post 38 are then locked together. This is done by selecting an appropriate aligned pair of holes 56 on post 38 and inserting locking pin 92 therethrough. The appropriate holes will be visible through slot 90 on guide sleeve 80.

The correct vertical orientation of post 38 is checked and, if necessary, is adjusted by engaging leveling assemblies 26. This is important because if post 38 is at an angle other than about ninety degrees to beam 12 and floor 16, the barbell 20 and weights 22 could roll off hooks 34 and injure the user. Leveling assemblies 26 are individually adjusted by rotating the foot 46 in the appropriate one of the first and second directions so that the length of the foot 46 extending outwardly from tube 44 is either increased or decreased as necessary. Foot 46 preferably includes a knurled outer surface that can be easily grasped and rotated even when in close contact with the ground. When the post 38 is determined to be as close to vertical as possible and leveling assemblies 26 are firmly positioned on the floor 16, then clamping bolts 112 and 98 are tightened so that support member 18 is securely locked to flange 12*b*/12*a* of beam 12 and is rigidly locked between beam 12 and floor 16. Support post 38 should be essentially immovable both laterally and vertically.

The second support member 18 is then secured to beam 12 in substantially the same manner. The only difference in the installation procedure is that the position of the second support member must be gauged relative to the first support member so that bar 20*a* of barbell 20 is correctly positioned and adequately supported on hooks 34. Thus, when the second support member 18 is loosely clamped to beam 12, it may be slidingly moved toward or away from the first support member 18. Once the appropriate relative positions of the two support member 18 are established, then the second support member 18 in the same manner as the first support member 18.

It is then necessary for the user to set the position of the bar supports 34 along support members 18 so that barbell 20 is in the correct position for exercising. Squat rack 10 is preferably used by the user facing the J-shaped hooks 34. The user selects the correct position for hooks 34, removes the pin 73 from a first one of bar support assemblies 32 and slides the sleeve 62 upwardly or downwardly along post 38 until the correct height for the hook 34 is reached. Pin 73 is then inserted into a set of aligned holes 56 and apertures 72 to lock that hook 34 in position. The other bar support assembly 32 is positioned at the same height on the other support member 18 and is locked into place. The squat rack 10 is then ready for the user to begin his/her workout.

Figure 11:
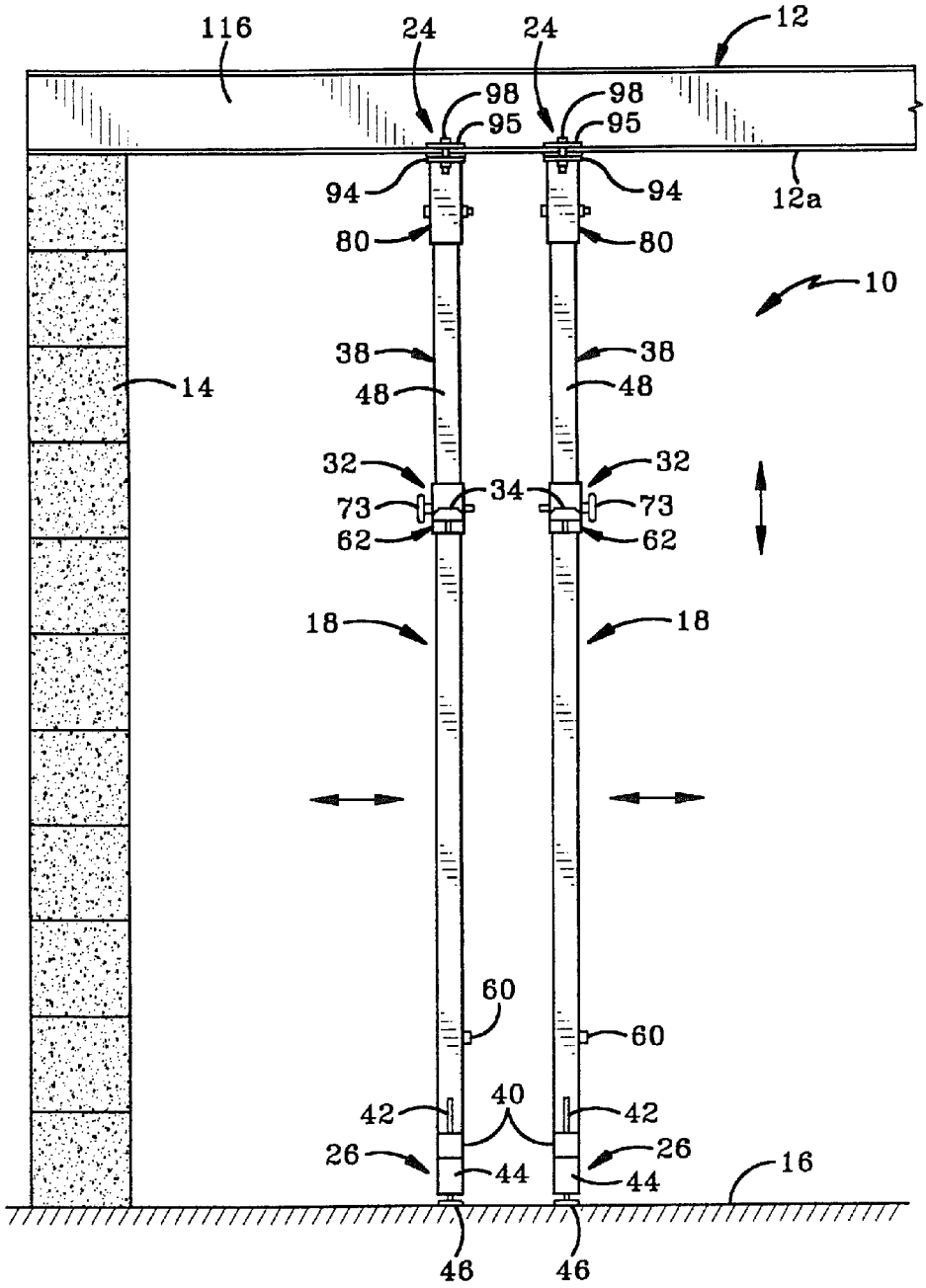
FIG. 11 is a front elevational view showing the squat rack with the support members moved inwardly toward each other and with the bar support assemblies being adjustable thereon.

When the workout is over and if the squat rack 10 is an obstruction in the room, the support members 18 may be loosened by slightly rotating the bolts 112 and 98 and, if necessary, reducing the extent to which the feet 46 extend outwardly from locking assemblies 26 so that casters 110 will engage flange 12*b*. Support member 18 is then slid along the beam 12 to another position. When support members 18 are in an appropriate storage position, such as is illustrated in FIG. 11, clamping bolts 112 and 98 are tightened and leveling assemblies 26 are re-engaged to lock support members 18 in place. Support member 18 can therefore be quickly and simply moved along beam 12 and positioned either for exercising or for storage without the need to disassemble the entire exercise device.

Figure 13:
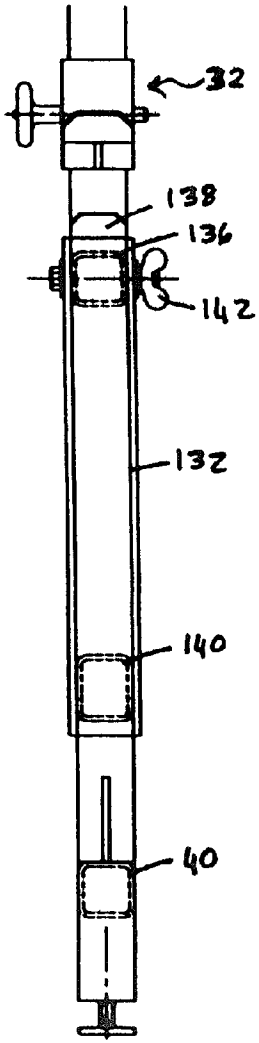
FIG. 13 is a partially cross-sectioned front view of the support member of FIG. 12.
Figure 12:
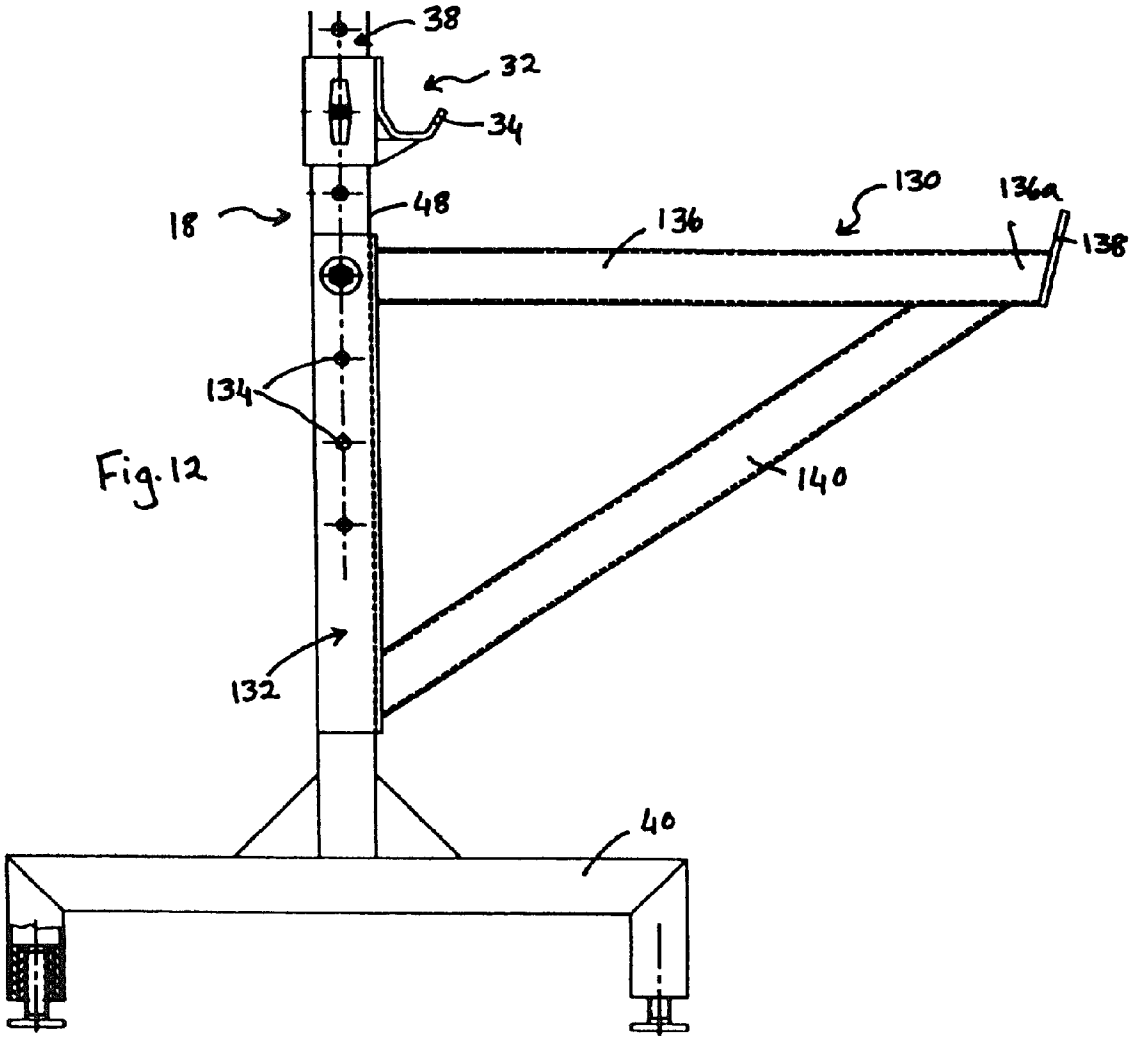
FIG. 12 is a side elevational view of the bottom portion of a support member showing a safety catch that may optionally be utilized with the squat rack.

Referring to FIGS. 12 and 13, there is shown a support member 18 that includes an optional safety catch assembly 130. Each support member 18 will include a safety catch assembly 130 thereon so that if a barbell 20 is accidentally dropped during an exercise session, the bar 20*a* (FIG. 1) thereof will land on the pair of safety catch assemblies 130 on the spaced-apart support posts 38 and will not strike the floor.

Each safety catch assembly 130 comprises a sleeve 132 that is complementary shaped and sized to be received around the walls of support post 38. Sleeve 132 includes a plurality of spaced apart apertures 134 formed therein. Apertures 134 are spaced to be selectively aligned with holes 56 in support post 38 when sleeve 132 is positioned at a desired height on support member 18. Safety catch assembly 130 further includes a substantially horizontal safety bar 136. Safety bar 136 extends outwardly away from proximate a top end of sleeve 132 and extends outwardly from front wall 48 of support post 38 for a substantially greater distance than does J-hook 34 of bar support assembly 32. Safety bar 136 is provided with a flange 138 proximate its free end 136*a*. Flange 138 extends upwardly from safety bar 136 and at an angle outwardly and forwardly away therefrom to prevent a barbell from rolling off safety bar 136. A brace 140 extends between sleeve 132 and the free end 136*a* of safety bar 136. Brace 140 is provided to strengthen the safety bar and prevent it from being deformed if struck by a barbell. Safety catch assembly 130 is secured to support post 38 by one or more push pins 142 that are inserted through aligned pairs of apertures 134 and holes 56. Any other suitable fastener may be utilized instead of push pin 142.

Figure 15:
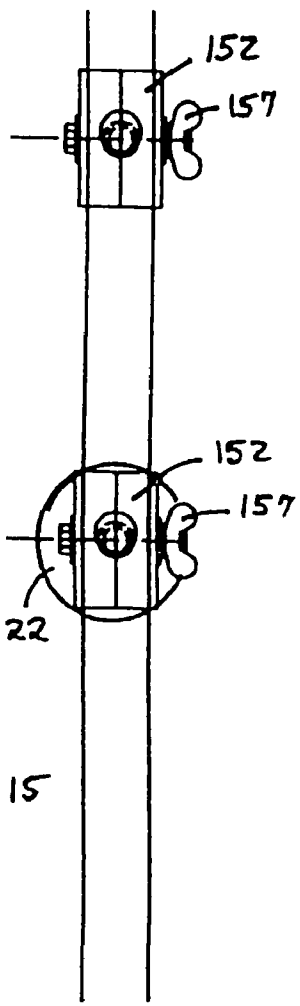
FIG. 15 is a rear view of the mid-section of the support member of FIG. 14.
Figure 14:
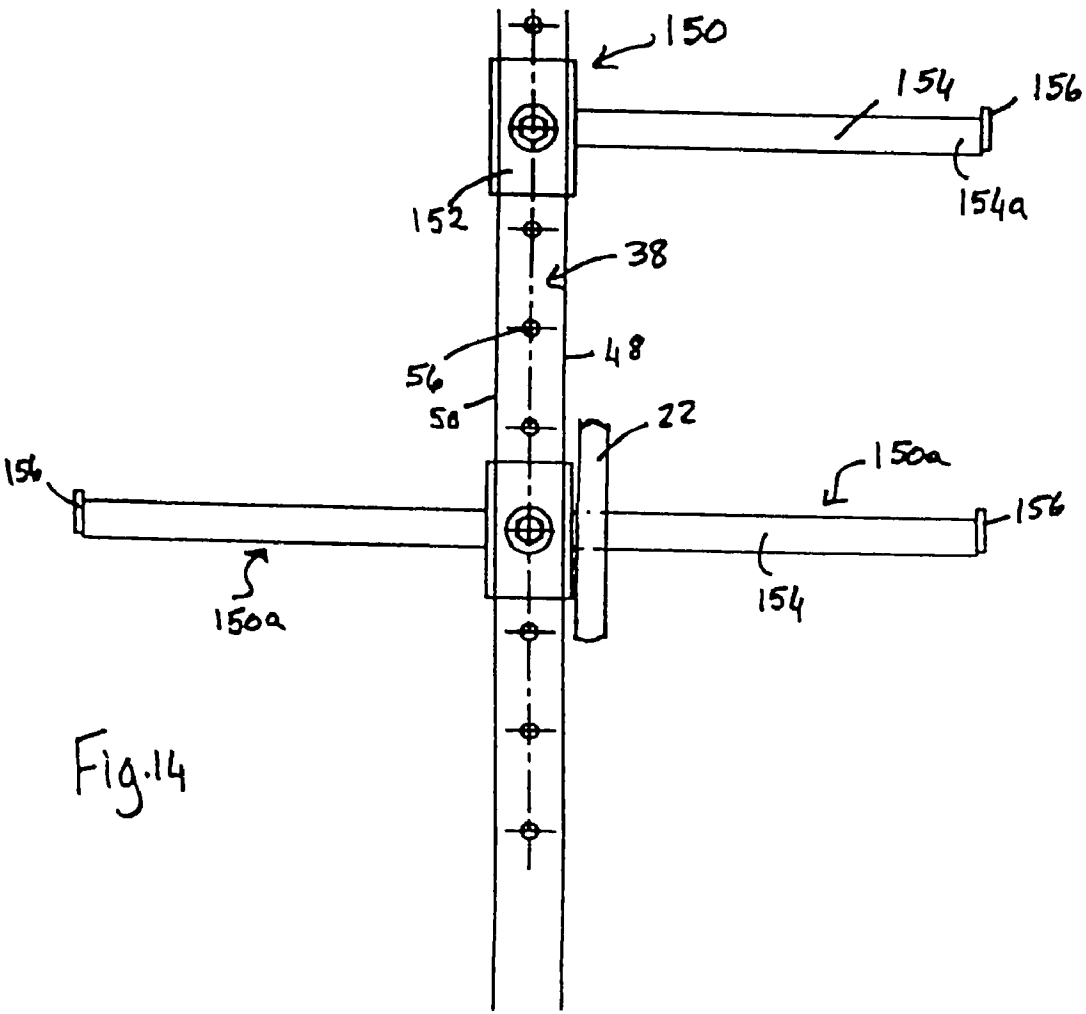
FIG. 14 is a side elevational view of a mid-section of a support member showing a weight rack that may optionally be utilized with the squat rack of the present invention.

Referring to FIGS. 14 and 15, squat rack 10 may further include one or more weight support assemblies 150 mounted on support members 18. Each weight support assembly 150 comprises a sleeve 152 that is complementary in shape and size so as to be received around support post 38. Sleeve 152 includes a pair of aligned apertures (not numbered) therein that are designed to be selectively aligned with a pair of holes 56 in support post 38. One or more horizontal support bars 154 extend outwardly away from sleeve 152. Each support bar 154 preferably includes an upstanding and offset flange 156 at a free end 154*a* thereof. Flange 156 allows weights to be slid onto support bar 154 but prevents those weights from accidentally being slid off support bar 154.

When weight support assembly 150 is secured to support post 38, support bar 154 preferably extends outwardly from either of the front wall 48 or rear wall 50 of post 38. In a weight support assembly 150*a* that includes two support bars 154, each one of bars 154 extends outwardly away from one of the front and rear walls 48, 50 of post 38. Weight support assembly 150 is secured in position on support post 38 by inserting a push pin 157 or other suitable fastener through the aligned pairs of apertures in assembly 150 and holes 56 on post 38.

A weight support assembly 150 and/or 150*a* may be engaged with one or both support members 18 when squat rack 10 is to be used or may, alternatively, only be engaged therewith when squat rack 10 is not being used. If weight support assemblies 150, 150*a* are engaged with support members 18 when squat rack 10 is in use, then assemblies 150 must be set at a height that will not interfere with a barbell being lifted off the bar support assemblies 32 and returned thereto. In this latter instance, weight support assemblies 150 preferably are slid down toward the crossbar 40 and are then secured in place. One or more weights 22 are slid onto support bar 154 for storage purposes by inserting the flange 156 at the free end 154*a* of support bar 154 through the central hole (not shown) in the weight 22. Once weight 22 has cleared flange 156 it is lowered onto bar 154 and slid as far inwardly toward post 38 as possible. When the weight 22 is to be used, it is slid along support bar 154 outwardly away from support post 38 and lifted slightly so that the flange 156 exits the central hole in the weight. The weight 22 can then be engaged with the bar 20*a* of a barbell 20 as shown in FIG. 1.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An exercise device comprising:

a pair of independent support members that are free of connections to each other; said support members being adapted to be suspended from a horizontal ceiling beam and being selectively linearly slidable toward and away from each other along the beam; and wherein each support member comprises:

a single elongated post;

a first end of the post adapted to adjustably engage a floor surface;

a clamp assembly disposed at a second end of the post and adapted to suspend the post from the beam; said clamp assembly being selectively engageable between a first fixed position where the support post is fixedly secured to the beam and a second movable position where the position of the support member on the beam is changeable; and a bar support assembly mounted for vertical movement on the post; and wherein said support members are selectively laterally positionable on the beam relative to each other and are adapted to retain a bar of a barbell therebetween.

2. The exercise device as defined in claim 1, further comprising a leveling assembly disposed at the first end of the post; said leveling assembly being adjustable to orient the post substantially at right angles to the floor surface.

3. The exercise device as defined in claim 2, wherein the post further includes a horizontal crossbar mounted at the first end thereof; whereby the post is substantially T-shaped when viewed from the side; and wherein the leveling assembly is mounted to the crossbar.

4. The exercise device as defined in claim 3, further comprising a second leveling assembly; and wherein the pair of leveling assemblies are mounted a spaced distance apart from each other on the crossbar.

5. The exercise device as defined in claim 4, wherein each leveling assembly comprises a tube member defining an internal bore and a foot screwed into said bore; said foot being rotatable to adjust the extent to which a ground engaging surface is disposed relative to the tube member.

6. The exercise device as defined in claim 1; wherein the clamp assembly includes:

a clamping member and a sliding member; and wherein the clamping member is engaged to lock said clamp assembly into the first fixed position and is disengaged to enable the sliding member to linearly slide along the beam and thereby change the position of the support member on the beam.

7. The exercise device as defined in claim 1, wherein the bar support assembly comprises a J-shaped hook that is selectively vertically positionable on the post.

8. The exercise device as defined in claim 7, wherein the post defines a plurality of aligned pairs of apertures disposed at spaced intervals from each other; and the hook defines a pair of aligned holes therein; and wherein the bar support assembly further includes a locking pin engageable in the aligned holes and one of the pairs of aligned apertures to lock the J-shaped hook to the post.

9. The exercise device as defined in claim 7, wherein the bar support assembly further comprises a sleeve having a front wall, a rear wall and opposing side walls that surround and define an interior cavity complementary in size and shape to the cross-sectional shape of the post; and wherein the J-shaped hook is mounted to the front wall of the sleeve.

10. The exercise device as defined in claim 9, wherein the post defines a plurality of apertures at spaced intervals from each other; and an opposed pair of the walls in the sleeve define a pair of aligned holes therein; and said sleeve is slidably movable along the post to selectively align the holes therein with one of the apertures on the post.

11. The exercise device as defined in claim 10, wherein the bar support assembly further includes a locking pin engageable in the aligned holes and selected one of the apertures to fixedly position the bar support assembly on the post a first distance from a floor surface; and wherein the locking pin is removable from the aligned holes and selected one of the apertures to permit sleeve to be vertically moved along the post to a different vertical position thereon.

12. The exercise device as defined in claim 1, further comprising a pair of safety catch assemblies, each safety catch assembly being engageable with one of the support members and selectively positioned on the support member a distance beneath the bar support assembly.

13. The exercise device as defined in claim 12, wherein each safety catch assembly comprises:

a safety sleeve complementary in cross-sectional shape to the post of the support member;

a safety bar extending outwardly away from proximate a top end of the safety sleeve; whereby said bar extends outwardly away from a front wall of the post and beyond an outermost end of the bar support assembly;

a flange extending upwardly away from proximate a free end of the safety bar; and a brace extending from proximate a bottom end of the safety sleeve and forwardly toward the free end of the safety bar and into engagement with the safety bar inwardly of the flange.

14. The exercise device as defined in claim 13, wherein the safety sleeve of the safety catch assembly further includes at least one pair of aligned apertures formed therein, said apertures being selectively alignable with a pair of aligned holes formed in the post; and the safety catch assembly further comprises a pin receivable through the aligned pairs of apertures and holes to secure the safety catch assembly to the post.

15. The exercise device as defined in claim 1, wherein said clamp assembly comprises:

a clamping plate adapted to clampingly engage the beam; and a plurality of casters adapted to slidingly move the post along the beam;

and wherein said clamping plate is engaged and the casters are disengaged when the clamp assembly is in the first position; and the clamping plate is disengaged and the casters are engaged when the clamp assembly is in the second position.

16. The exercise device as defined in claim 15, further comprising at least one weight support assembly selectively positionable on the post of only one of the support members; said weight support assembly being configured to retain one or more of the weights thereon when said weights are not engaged on the barbell.

17. The exercise device as defined in claim 16, wherein the weight support assembly comprises:

a support sleeve complementary in cross-sectional shape to the post of the support member;

a pair of aligned apertures formed in opposing faces of the support sleeve and being selectively alignable with a pair of aligned holes in the post of the support member and adapted to receive a push pin therethrough when so aligned;

a support bar extending outwardly away from the support sleeve; said support bar being of a circular cross-sectional shape complementary to the shape of a central aperture in a weight; said support bar being adapted to be received through the central aperture of at least one weight; and a flange extending upwardly away from proximate a free end of the support bar.

18. The exercise device as defined in claim 1, further comprising:

a barbell and at least one pair of weights that are selectively engageable with said barbell.

19. An exercise device comprising:

a pair of support members that are selectively positionable laterally relative to each other; each support member comprising:

an elongated Post where a first end of the post is adapted to engage a floor surface;

a clamp assembly disposed at a second end of the post and adapted to support the post from a horizontal I-beam; said clamp assembly being selectively engageable between a first fixed position and a second movable position where the position of the support member on the I-beam is changed; and wherein the clamp assembly comprises:

a horizontal plate extending at right angles outwardly from the second end of the post;

a clamping plate extending vertically outwardly from one end of a sleeve that fits over the second end of the post, said clamping plate having a first leg that is substantially coplanar with a first surface of the sleeve, and having a second leg disposed at right angles to the horizontal plate and spaced a distance vertically from the horizontal plate;

a clamping member comprising:

a first clamping member provided proximate an end of the horizontal plate remote from the sleeve; said first clamping member adapted to selectively engage a first region of a flange of the I-beam;

a second clamping member provided on the second leg of the clamping plate and adapted to selectively engage a second region of the flange of the I-beam; and a sliding member comprising a plurality of rotatable casters provided on the second leg of the clamping plate and adapted to selectively engage the second region of the flange of the I-beam; and wherein the first and second clamping members are engaged to lock the clamp assembly into the first fixed position and thereby fixedly secure the support member on the I-beam; and the first and second clamping members are disengaged to allow the casters to be used to move the support member along the second region of the flange and thereby change the position of the support member on the I-beam; and a bar support assembly mounted for vertical movement on the post; said bar support assembly being adapted to retain one end of a bar of a barbell thereon; and wherein said support members are selectively laterally positionable on the I-beam relative to each other and are adapted to retain the bar of a barbell therebetween.

20. The exercise device as defined in claim 19, wherein the horizontal plate extends outwardly from the sleeve; and the first leg of the clamping plate extends vertically outwardly from the sleeve.

21. The exercise device as defined in claim 20, wherein the sleeve comprises a front wall, a rear wall and a pair of side walls disposed to surround and define an interior cavity; and wherein said cavity is complementary in size and shape for the sleeve to tightly fit over the second end of the post.

22. The exercise device as defined in claim 21, wherein the post includes a plurality of apertures defined at spaced intervals from each other; and wherein one of the walls of the sleeve defines a slot therein; said slot being selectively alignable with one or more of the apertures in the post; and wherein the clamp assembly further includes a locking pin engageable in the aligned slot and selected aperture to lock the sleeve onto the second end of the post.

23. In combination:

an I-beam fixedly secured between two vertical walls and spaced a vertical distance above a floor surface;

an exercise device comprising;

a pair of independent support members that are each individually suspended from the I-beam, said support members being selectively linearly slidable relative to each other along said beam; each support member comprising:

an elongated post having a first end thereof adapted to adjustably engage the floor surface;

a clamp assembly disposed at a second end of the post and being engageable with the beam to suspend the post therefrom; said clamp assembly being adjustable between a first position where the post is locked in a fixed position on the beam and a second position where the post is linearly slidable along the beam; and a bar support assembly mounted on each post; said bar support assembly being selectively vertically moveable along said post;

a barbell bar selectively positionable upon the spaced-apart bar support assemblies on the spaced-apart posts; and a plurality of weights, selectively slidable upon either end of the barbell bar.

24. The combination as defined in claim 23, wherein the clamp assembly comprising:

a clamping member that selectively engages at least one of a first and second flange on the I-beam; and at least one caster that selectively engages at least one of the first and second flanges on the I-beam; and wherein the clamp assembly is adjustable to bring either the clamping member into engagement with the I-beam or the caster into engagement with the I-beam.

* * * * *